US011480309B2

(12) United States Patent
Chang

(10) Patent No.: US 11,480,309 B2
(45) Date of Patent: Oct. 25, 2022

(54) CANDLEWICK AND ELECTRONIC CANDLE

(71) Applicant: Guangzhou Jiaheng Crafts Co., Ltd., Guangdong (CN)

(72) Inventor: Jiang Chang, Guangdong (CN)

(73) Assignee: Guangzhou Jiaheng Crafts Co., Ltd., Guangdong (CN)

( * ) Notice: Subject to any disclaimer, the term of this patent is extended or adjusted under 35 U.S.C. 154(b) by 0 days.

(21) Appl. No.: 17/278,398

(22) PCT Filed: Sep. 18, 2020

(86) PCT No.: PCT/CN2020/116102
§ 371 (c)(1),
(2) Date: Mar. 22, 2021

(87) PCT Pub. No.: WO2021/203628
PCT Pub. Date: Oct. 14, 2021

(65) Prior Publication Data

US 2022/0074561 A1 Mar. 10, 2022

(30) Foreign Application Priority Data

Apr. 10, 2020 (CN) ..... 202020528348.9

(51) Int. Cl.
*F21S 10/04* (2006.01)

(52) U.S. Cl.
CPC ..... *F21S 10/046* (2013.01)

(58) Field of Classification Search
CPC ..... F21S 10/046
See application file for complete search history.

(56) References Cited

U.S. PATENT DOCUMENTS 11,009,201 B1 * 5/2021 Liao ..... F21S 10/046
2013/0050985 A1 * 2/2013 Kwok ..... F21S 10/046 362/96

(Continued)

FOREIGN PATENT DOCUMENTS

CN 105258070 A 1/2016
CN 206347521 U 7/2017

(Continued)

OTHER PUBLICATIONS

International Search Report (Form PCT/ISA/210) for International Application No. PCT/CN2020/116102 dated Jan. 12, 2021 (5 pages including English translation).

(Continued)

*Primary Examiner* — Alexander K Garlen
(74) *Attorney, Agent, or Firm* — Withrow & Terranova, P.L.L.C.; Vincent K. Gustafson

(57) ABSTRACT

Disclosed are a candlewick and an electronic candle. The candlewick includes a candle flame sheet, a light-emitting element, a left support, and a right support. The left support and the right support are assembled to constitute a flame sheet support. The light-emitting element is mounted in the flame sheet support. A first support beam for supporting the candle flame sheet is disposed in the left support. An upward-facing first support portion is formed at one end of the first support beam. A downward-facing limiting opening is formed at a lower portion of the candle flame sheet. A top end of the first support portion abuts against a top wall of the limiting opening.

10 Claims, 3 Drawing Sheets

(56) References Cited

U.S. PATENT DOCUMENTS

| | | | | |
|---|---|---|---|---|
| 2014/0218903 | A1* | 8/2014 | Sheng | F21S 10/046 362/190 |
| 2015/0233538 | A1* | 8/2015 | Sheng | F21S 10/046 362/190 |
| 2016/0040844 | A1* | 2/2016 | Patton | F21S 6/001 362/362 |
| 2016/0298816 | A1* | 10/2016 | Fang | F21S 10/046 |
| 2017/0167677 | A1* | 6/2017 | Patton | F21S 9/02 |
| 2017/0191633 | A1 | 6/2017 | Patton et al. | |
| 2018/0187848 | A1* | 7/2018 | Patton | F21S 6/001 |
| 2019/0338906 | A1* | 11/2019 | Ganz | F21S 10/046 |
| 2020/0149693 | A1* | 5/2020 | Feng | F21S 10/046 |
| 2020/0191348 | A1* | 6/2020 | Fan | F21S 10/046 |
| 2021/0048173 | A1* | 2/2021 | Li | F21V 15/01 |
| 2021/0095827 | A1* | 4/2021 | Li | F21S 10/046 |
| 2021/0102672 | A1* | 4/2021 | Cheng | F21S 6/001 |
| 2021/0178003 | A1* | 6/2021 | Li | F21S 8/035 |
| 2021/0247042 | A1* | 8/2021 | Wu | A61L 9/032 |

FOREIGN PATENT DOCUMENTS

| | | | |
|---|---|---|---|
| CN | 206410077 | U | 8/2017 |
| CN | 207162403 | U | 3/2018 |
| CN | 207750939 | U | 8/2018 |
| CN | 208951904 | U | 6/2019 |

OTHER PUBLICATIONS

Written Opinion (Form PCT/ISA/237) for International Application No. PCT/CN2020/116102 dated Jan. 12, 2021 (5 pages including English partial translation).

* cited by examiner

CANDLEWICK AND ELECTRONIC CANDLE

CROSS-REFERENCE TO RELATED APPLICATIONS

This application is a national stage filing under 35 U.S.C. § 371 of International Application No. PCT/CN2020/116102, filed Sep. 18, 2020, which claims priority to Chinese Patent Application No. 202020528348.9, filed Apr. 10, 2020, wherein the entire contents of the foregoing applications are hereby incorporated by reference herein.

TECHNICAL FIELD

The present disclosure relates to the technical fields of lighting and decorations, and more particularly, to a candlewick and an electronic candle.

BACKGROUND

Electronic candles, also known as electronic LED candles, simulate the shapes of candles and flame sheets. They can not only provide practical and secure lighting but also achieve ornamental and decorative purposes. Common electronic candles support the flame sheet by guiding an iron bar through the lower part of the flame sheet, so that the flame sheet swings over the iron bar after being lit. Such a structure has defects such as easy bending of the iron bar and inconvenience in assembling and disassembling the iron bar in the electronic candles.

SUMMARY

To solve at least one of the preceding technical problems and facilitate assembly and disassembly, the present disclosure provides a candlewick and an electronic candle. The following technical solutions are used:

The candlewick provided by the present disclosure includes a candle flame sheet, a light-emitting element, a left support, and a right support. The left support and the right support are assembled to constitute a flame sheet support. The light-emitting element is mounted in the flame sheet support. A first support beam for supporting the candle flame sheet is disposed in the left support. An upward-facing first support portion is formed at one end of the first support beam. A downward-facing limiting opening is formed at a lower portion of the candle flame sheet. A top end of the first support portion abuts against a top wall of the limiting opening. A counterweight frame is disposed at the lower portion of the candle flame sheet. The counterweight frame includes an upper horizontal beam, a lower horizontal beam, and two vertical beams. The upper horizontal beam, the lower horizontal beam, and the two vertical beams constitute a rectangular frame structure. The lower portion of the candle flame sheet is mounted on the upper horizontal beam.

In some embodiments, a hollow structure is formed on the candle flame sheet.

In some embodiments, a left top wall is formed on the top of the left support. A right top wall is formed on the top of the right support. The left top wall and the right top wall are assembled to constitute a top structure of the flame sheet support. A through opening for the candle flame sheet to pass through is formed at the middle portion of the top structure.

In some embodiments, a left half cavity for mounting the light-emitting element is formed on the left support. A left groove is formed on a lower side wall of the left half cavity. A right half cavity for mounting the light-emitting element is formed on the right support. A right groove is formed on a lower side wall of the right half cavity. The left half cavity and the right half cavity are assembled to constitute a mounting portion for mounting the light-emitting element. The left groove and the right groove are assembled to constitute a ring clamping groove.

In some embodiments, the mounting portion is disposed by tilting towards the through opening.

In some embodiments, a lower left bottom plate and an upper left bottom plate are formed at a lower portion of the left support. A left mounting groove for mounting a circuit board is constituted between the upper left bottom plate and the lower left bottom plate. A lower right bottom plate and an upper right bottom plate are formed at a lower portion of the right support. A right mounting groove for mounting the circuit board is constituted between the upper right bottom plate and the lower right bottom plate. The left mounting groove and the right mounting groove are assembled to constitute a ring mounting groove for mounting the circuit board.

In some embodiments, the lower portion of the candle flame sheet is formed as a counterweight, and the limiting opening is formed at the bottom of the counterweight.

The electronic candle provided by the present disclosure includes the candlewick.

The electronic candle provided by the present disclosure includes a candle body and the candlewick.

The beneficial effects are as follows: the left support and the right support are assembled by disposing the lower portion of the candle flame sheet on the top of the first support portion through the limiting opening, thereby implementing easy and convenient assembly and disassembly. The present disclosure can be widely applied to the technical fields of lighting and decorations.

DETAILED DESCRIPTION

Figure 1:
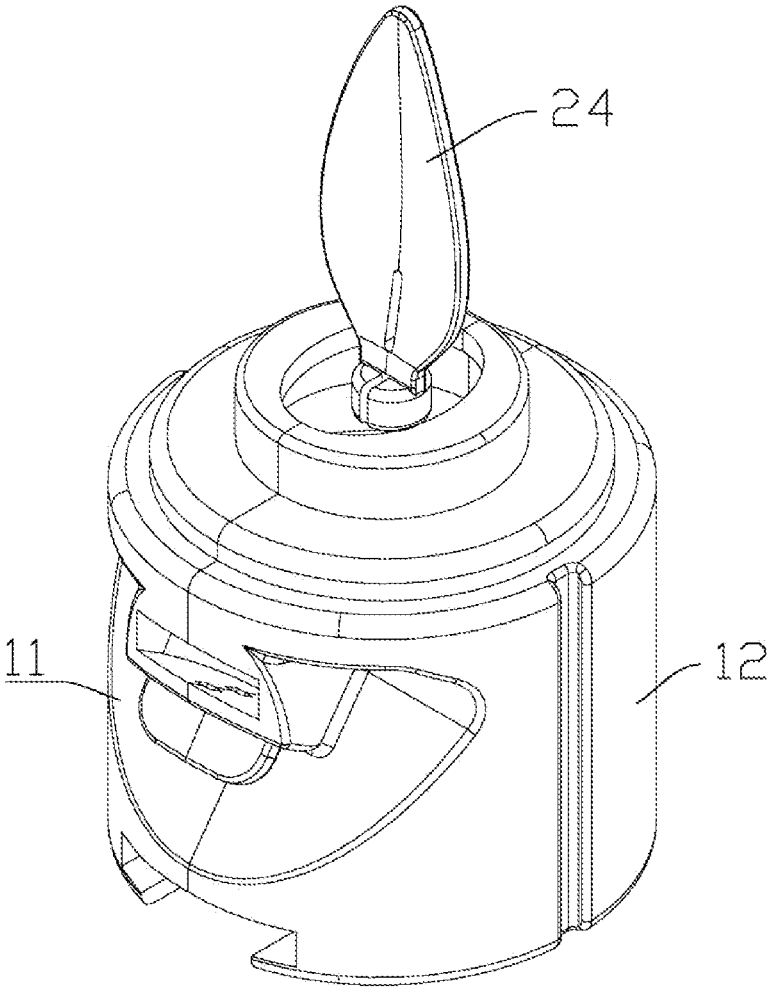
FIG. 1 is a structural schematic diagram of a candlewick.
Figure 2:
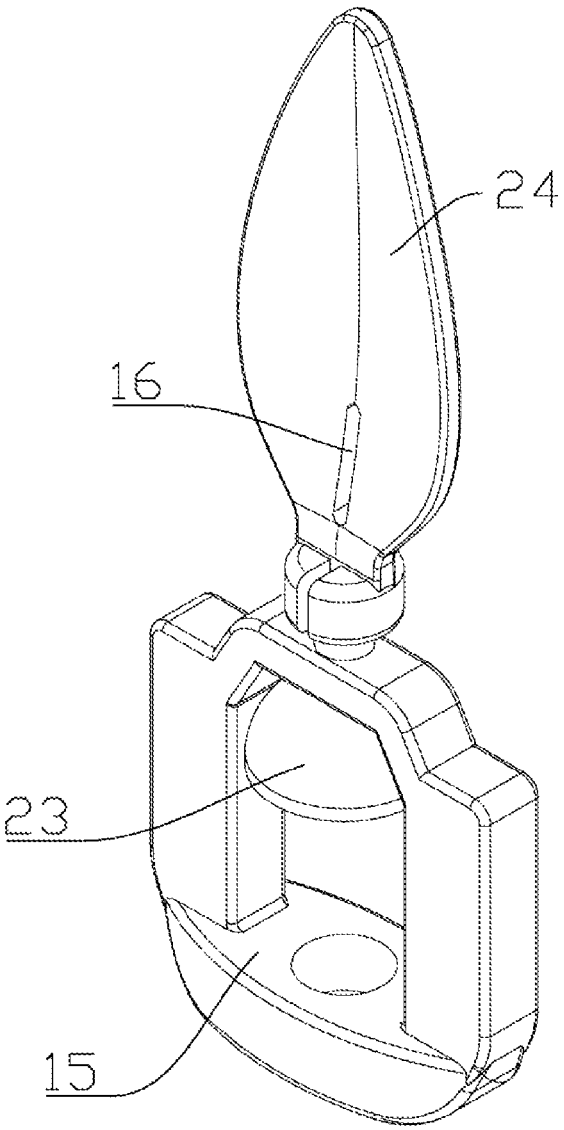
FIG. 2 is a structural schematic diagram of a candle flame sheet.
Figure 3:
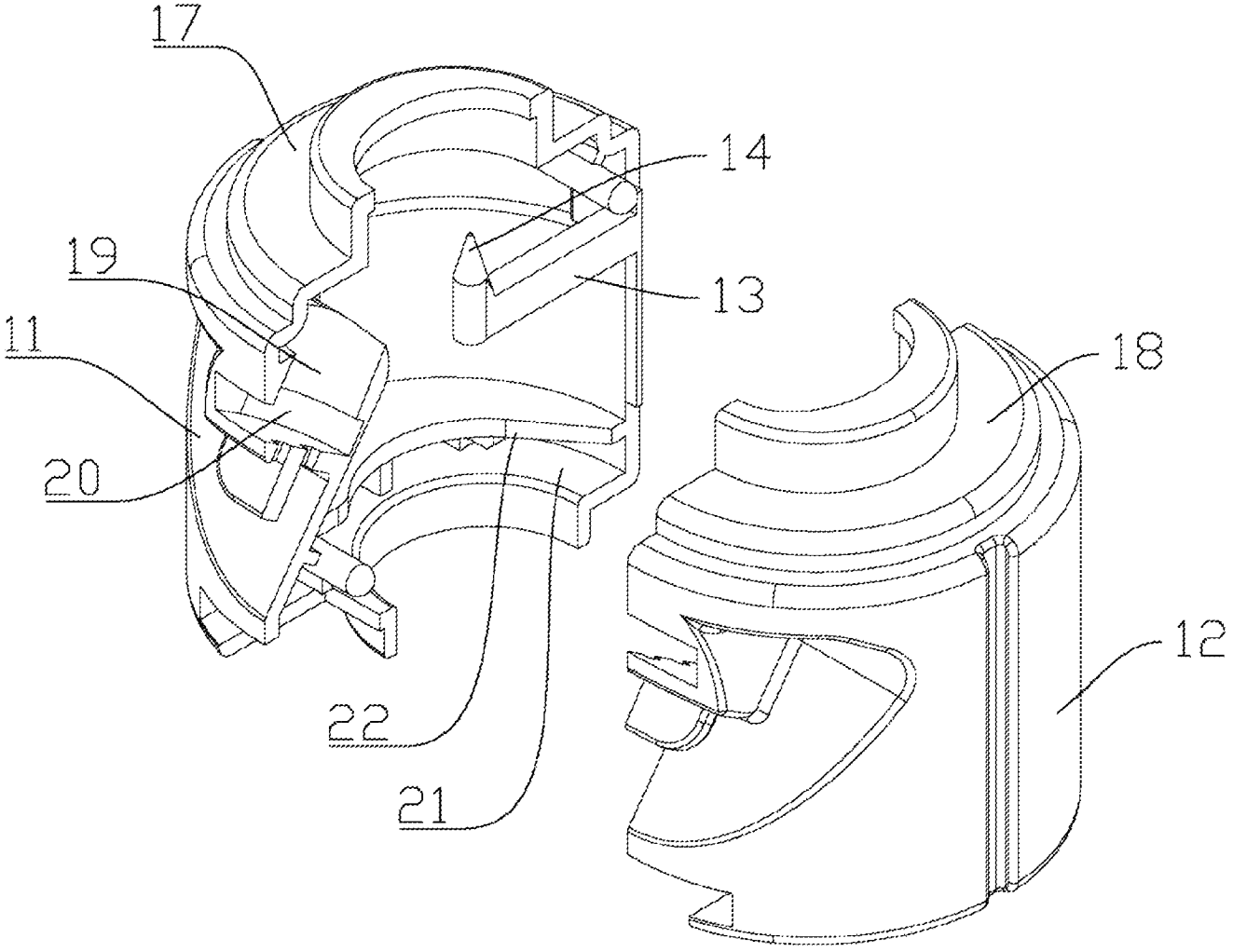
FIG. 3 is a structural schematic diagram of a disassembled left support and right support.

The following further describes the present disclosure with reference to FIG. 1 to FIG. 3.

The present disclosure relates to an electronic candle, which includes a candlewick.

The present disclosure relates to an electronic candle, which includes a candle body and a candlewick. The candlewick is mounted at an upper portion of the candle body.

The present disclosure relates to a candlewick, which includes a candle flame sheet, a light-emitting element, a left support 11, and a right support 12. The left support 11 and the right support 12 are assembled to constitute a flame sheet support. The light-emitting element is mounted in the flame sheet support. The candle flame sheet is mounted in the flame sheet support. The light-emitting element illuminates the candle flame sheet to produce candle light.

A hollow structure 16 is formed on the candle flame sheet. The light-emitting element illuminates the candle flame sheet through the hollow structure 16. Such practice makes the light effect more realistic, and can simulate a more aesthetic flame when the candle flame sheet swings.

A first support beam 13 for supporting the candle flame sheet is disposed in the left support 11. An upward-facing first support portion 14 is formed at one end of the first support beam 13. The top of the first support portion 14 is a tip or a curved surface. A flame sheet structure 24 is formed at an upper portion of the candle flame sheet. A downward-facing limiting opening is formed at a lower portion of the candle flame sheet. A top wall of the limiting opening is a curved surface. A top end of the first support portion 14 abuts against the top wall of the limiting opening, facilitating assembly and disassembly of the candle flame sheet and the flame sheet support.

The lower portion of the candle flame sheet is formed as a counterweight 23. The counterweight 23 moves the center of gravity of the candle flame sheet downward, so that the candle flame sheet swings smoothly. The limiting opening is formed at the bottom of the counterweight 23.

A counterweight frame 15 is disposed at the lower portion of the candle flame sheet. The counterweight frame 15 includes an upper horizontal beam, a lower horizontal beam, and two vertical beams. The upper horizontal beam, the lower horizontal beam, and the two vertical beams constitute a rectangular frame structure. The lower portion of the candle flame sheet is mounted on the upper horizontal beam. A hollow area of the rectangular frame structure is enough to make the counterweight frame 15 not touch the first support beam 13 when the candle flame sheet swings, thereby ensuring that the candle flame sheet swings smoothly.

A left top wall 17 is formed on the top of the left support 11. A right top wall 18 is formed on the top of the right support 12. The left top wall 17 and the right top wall 18 are assembled to constitute a top structure of the flame sheet support. A through opening for the candle flame sheet to pass through is formed at the middle portion of the top structure. A groove opening is formed on each of the left top wall 17 and the right top wall 18, and the two groove openings are assembled to form the through opening.

A left half cavity 19 for mounting the light-emitting element is formed on the left support 11. A left groove 20 is formed on a lower side wall of the left half cavity 19. A right half cavity for mounting the light-emitting element is formed on the right support 12. A right groove is formed on a lower side wall of the right half cavity. The left half cavity 19 and the right half cavity are assembled to constitute a mounting portion for mounting the light-emitting element. The mounting portion is disposed by tilting towards the through opening.

The left groove 20 and the right groove are assembled to constitute a ring clamping groove, which is used to fasten the light-emitting element after assembly.

A lower left bottom plate 21 and an upper left bottom plate 22 are formed at a lower portion of the left support 11. A left mounting groove for mounting a circuit board is constituted between the upper left bottom plate 22 and the lower left bottom plate 21. A lower right bottom plate and an upper right bottom plate are formed at a lower portion of the right support 12. A right mounting groove for mounting the circuit board is constituted between the upper right bottom plate and the lower right bottom plate. The left mounting groove and the right mounting groove are assembled to constitute a ring mounting groove for mounting the circuit board. The circuit board is connected to the light-emitting element through a conducting wire.

The foregoing describes the implementations of the present disclosure in detail with reference to the accompanying drawings. However, the present disclosure is not limited to the foregoing implementations. Within the scope of knowledge possessed by a person of ordinary skill in the art, various changes can further be made without departing from the purpose of the present disclosure.

What is claimed is:

1. A candlewick, comprising:

a candle flame sheet;

a light-emitting element;

a left support; and a right support, wherein the left support and the right support are assembled to constitute a flame sheet support, the light-emitting element is mounted in the flame sheet support, a first support beam for supporting the candle flame sheet is disposed in the left support, an upward-facing first support portion is formed at one end of the first support beam, a downward-facing limiting opening is formed at a lower portion of the candle flame sheet, a top end of the first support portion abuts against a top wall of the limiting opening, a counterweight frame is disposed at the lower portion of the candle flame sheet, the counterweight frame comprises an upper horizontal beam, a lower horizontal beam, and two vertical beams, the upper horizontal beam, the lower horizontal beam, and the two vertical beams constitute a rectangular frame structure, and the lower portion of the candle flame sheet is mounted on the upper horizontal beam.

2. The candlewick of claim 1, wherein a hollow structure is formed on the candle flame sheet.

3. The candlewick of claim 1, wherein a left top wall is formed on the top of the left support, a right top wall is formed on the top of the right support, the left top wall and the right top wall are assembled to constitute a top structure of the flame sheet support, and a through opening for the candle flame sheet to pass through is formed at the middle portion of the top structure.

4. The candlewick of claim 3, wherein a left half cavity for mounting the light-emitting element is formed on the left support, a left groove is formed on a lower side wall of the left half cavity, a right half cavity for mounting the light-emitting element is formed on the right support, a right groove is formed on a lower side wall of the right half cavity, the left half cavity and the right half cavity are assembled to constitute a mounting portion for mounting the light-emitting element, and the left groove and the right groove are assembled to constitute a ring clamping groove.

5. The candlewick of claim 4, wherein the mounting portion is disposed by tilting towards the through opening.

6. The candlewick of claim 1, wherein a lower left bottom plate and an upper left bottom plate are formed at a lower portion of the left support, a left mounting groove for mounting a circuit board is constituted between the upper left bottom plate and the lower left bottom plate, a lower right bottom plate and an upper right bottom plate are formed at a lower portion of the right support, a right mounting groove for mounting the circuit board is constituted between the upper right bottom plate and the lower right bottom plate, and the left mounting groove and the right mounting groove are assembled to constitute a ring mounting groove for mounting the circuit board.

7. The candlewick of claim 1, wherein the lower portion of the candle flame sheet is formed as a counterweight, and the limiting opening is formed at the bottom of the counterweight.

8. An electronic candle, comprising the candlewick of claim 1.

9. An electronic candle, comprising a candle body and the candlewick of claim 1.

10. The candlewick of claim 1, wherein the top of the first support portion is a tip or a curved surface, and a top wall of the limiting opening is a curved surface.

* * * * *